US011992126B2

(12) United States Patent
Wilkins

(10) Patent No.: US 11,992,126 B2
(45) Date of Patent: May 28, 2024

(54) TODDLER BUNK BEDS

(71) Applicant: Cursonia Wilkins, Edwardsville, IL (US)

(72) Inventor: Cursonia Wilkins, Edwardsville, IL (US)

( * ) Notice: Subject to any disclaimer, the term of this patent is extended or adjusted under 35 U.S.C. 154(b) by 0 days.

(21) Appl. No.: 17/321,921

(22) Filed: May 17, 2021

(65) Prior Publication Data

US 2022/0265056 A1 Aug. 25, 2022

Related U.S. Application Data

(60) Provisional application No. 63/152,274, filed on Feb. 22, 2021.

(51) Int. Cl.

| | |
|---|---|
| ***A47C 17/50*** | (2006.01) |
| ***A47C 19/20*** | (2006.01) |
| ***A47D 7/00*** | (2006.01) |

(52) U.S. Cl.

CPC ..... *A47C 19/20* (2013.01); *A47D 7/007* (2013.01)

(58) Field of Classification Search

CPC ..... A47C 17/50; A47C 19/207; A47C 19/205; A47C 19/202; A47C 19/20; A47D 7/007

See application file for complete search history.

(56) References Cited

U.S. PATENT DOCUMENTS

| | | | | | |
|---|---|---|---|---|---|
| 331,706 | A | * | 12/1885 | Hofstatter | A47C 17/1756 5/41 |
| 2,337,266 | A | * | 12/1943 | O'Dell | A47B 83/00 5/308 |
| 2,601,685 | A | * | 7/1952 | Womack | A47C 17/86 5/503.1 |
| 4,913,262 | A | * | 4/1990 | DeBlois | A47C 19/20 5/9.1 |

(Continued)

FOREIGN PATENT DOCUMENTS

| | | | | |
|---|---|---|---|---|
| CN | 204698196 U | * | 10/2015 | A47C 19/20 |
| CN | 206238905 U | * | 6/2017 | |

(Continued)

OTHER PUBLICATIONS

Frank Williams, How to make a bunk bed ladder, Jul. 6, 2020, Youtube, https://www.youtube.com/watch?v=h13iSfle87A, Ladder with Grooves (Year: 2020).*

(Continued)

*Primary Examiner* — Justin C Mikowski
*Assistant Examiner* — Ifeolu A Adeboyejo
(74) *Attorney, Agent, or Firm* — Dale J. Ream

(57) ABSTRACT

The present invention relates to toddler bunk beds which are a space-saving furniture assembly that is ideal to accommodate multiple children in a single room. The toddler bunk beds comprise multiple beds independently mounted at safe heights and feature side rails to prevent toddlers from falling out and sustaining serious injuries. The toddler bunk beds (Continued)

include a storage drawer at the bottom area of the furniture assembly to keep the belongings of children and to conserve space. The toddler bunk beds are toddler friendly with appropriately sized beds to accommodate toddlers. The present invention offers a safe and comfortable bunk bed furniture assembly for toddlers.

1 Claim, 5 Drawing Sheets

(56) References Cited

U.S. PATENT DOCUMENTS

| | | | | | |
|---|---|---|---|---|---|
| 5,713,650 | A * | 2/1998 | King | A47C 19/22 | 5/2.1 |
| 5,983,420 | A * | 11/1999 | Tilley | A47B 88/9414 | 5/2.1 |
| 6,721,969 | B1 * | 4/2004 | Lupo | A47C 17/86 | 5/9.1 |
| 6,966,080 | B2 * | 11/2005 | Connell | A47C 17/86 | 5/503.1 |
| D513,370 | S * | 1/2006 | Nobile | D6/384 | |
| 7,793,367 | B1 * | 9/2010 | Ruiter | A47C 19/202 | 5/2.1 |
| 10,213,026 | B2 * | 2/2019 | Rohr | A47C 19/024 | |
| 11,022,162 | B2 * | 6/2021 | Leng | A47C 19/20 | |
| 2005/0273929 | A1 * | 12/2005 | Hennings | A47C 19/00 | 5/288 |
| 2018/0360225 | A1 * | 12/2018 | Leng | A47C 19/005 | |
| 2019/0038038 | A1 * | 2/2019 | Leng | F16B 7/0426 | |
| 2019/0335911 | A1 * | 11/2019 | Pawelczak | A47C 21/08 | |

FOREIGN PATENT DOCUMENTS

| | | | | |
|---|---|---|---|---|
| JP | 2007319367 | A * | 12/2007 | |
| JP | 2009297381 | A * | 12/2009 | A47C 19/20 |
| JP | 6754868 | B1 * | 9/2020 | |
| JP | 7106072 | B2 * | 7/2022 | |
| KR | 200356062 | Y1 * | 7/2004 | A47C 19/20 |
| KR | 100993839 | B1 * | 11/2010 | A47C 19/20 |
| KR | 1345910 | B1 * | 12/2013 | A47C 19/20 |

OTHER PUBLICATIONS

Iron Seagull, Bunk Bed Improved by Modders!, Mar. 28, 2021, Youtube, https://www.youtube.com/watch?v=jPedr17PUBU&t=2s, Bed Egrees (Year: 2021).*

Jay Bates, DIY Bunk Bed. Easy, Strong, Inexpensive., Nov. 30, 2014, Youtube, https://www.youtube.com/watch?v=OQiHX1KXSiU&t=97s, Post 1 (Year: 2014).*

Backyardables, Toddler Pallet Bunk Bed Made By Toddler—Journey To Sustainability, Jun. 28, 2016, Youtube, https://www.youtube.com/watch?v=VZJGXDR2pp0, Post 2 (Year: 2016).*

April Wilkerson, Build a Bunk Bed with Rock Climbing Wall, Dec. 15, 2019, Youtube, https://www.youtube.com/watch?v= 8tEQulx6las, Post 3 (Year: 2019).*

Mr. Build It, DIY Twin Built-in Bunk Bed For Kids, Apr. 28, 2020, Youtube, https://www.youtube.com/watch?v=XHT3RNdLXn0, LED Upper Frame (Year: 2020).*

* cited by examiner

TODDLER BUNK BEDS

CROSS-REFERENCE TO RELATED APPLICATION

The present application claims priority to, and the benefit of, U.S. Provisional Application No. 63/152,274, which was filed on Feb. 22, 2021 and is incorporated herein by reference in its entirety.

FIELD OF THE INVENTION

The present invention relates generally to the field of bed assemblies. More specifically, the present invention relates to toddler bunk beds designed for space-saving in a room for families with multiple small children. The bunk beds of the present invention comprise two toddler-sized beds stacked vertically, one generally on top of the another, such that the beds are configured for safety and for preventing toddlers from the risk of falling and getting injured. The bunk beds feature a ladder to allow the toddler to climb up to the upper bed through the foot of the upper bed. Additionally, the toddler bunk beds feature side rails for the safety of the toddlers and include a storage drawer at the bottom of the lower bed to provide storage for each child's belongings. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, various bed assemblies are known in the state of the art. Generally, a bed is a piece of furniture used for lying down, sleeping and resting. Different kinds of beds are available, such as home beds, hospital beds, military beds, vehicle beds, staircase beds, alcove beds, sofa beds, day beds etc., depending on the needs of the users. Bunk beds are also known to accommodate multiple beds for multiple users while occupying floor space of only one bed. Such beds are commonly seen on ships, in the military, and in hotels, dormitories, summer camps, prisons and the like. Additionally, people having multiple children may use bunk beds for their children to save space in their home.

With bunk beds, one bed frame is stacked on top of another bed frame, and in a similar manner two or more beds can be stacked to accommodate a greater number of people. When parents use conventional bunk beds for their toddlers, the children that are still used to sleeping in a crib often begin to climb out, which can lead to serious injuries. The toddler sleeping or resting on the topmost bed of the bunk beds has the highest chance of falling down and getting injured, as the top bed is usually set at a dangerous height. Typical bunk beds are designed with the comfort of larger children as the focus. As such, toddlers or small children are not often considered for such bunk beds. Typical bunk beds heretofore known have bed frames large enough to accommodate adults, and therefore such beds are often too big for a toddler. Further, while conventional bunk beds are designed to save space within rooms, other pieces of furniture such as cabinets, cupboards, dressers, etc., occupy additional floor space to accommodate the belongings of the user. People may desire to eliminate the use of cabinets or dressers to save space in small rooms.

Therefore, there exists a long felt need in the art for a bed assembly or furniture assembly that can accommodate multiple children while saving space in the home. There is also a long felt need in the art for a bunk bed that is designed with toddlers in mind, and focusing on the toddlers' comfort and safety. Additionally, there is a long felt need in the art for a toddler bunk bed that includes bed frames stacked one over the other at a safe height, and that prevent toddlers from becoming injured while utilizing the same. Moreover, there is a long felt need in the art for a toddler bunk bed that includes a safety mechanism to prevent a toddler from falling out of the bed and becoming injured, and that is designed to both conserve space in a room and provide storage space for the toddler's belongings. Finally, there is a long felt need in the art for a toddler bunk bed that is relatively inexpensive to manufacture and that is both safe and easy to use.

The subject matter disclosed and claimed herein, in one potential embodiment thereof, comprises improved toddler bunk beds designed for children who are too large for a crib, yet too small for a twin bed. The bunk beds comprise: four corner poles designed in vertical orientations; an upper frame secured to the four poles; a lower frame secured to the four poles; and an independent drawer secured to the bottom of the four poles. The upper frame comprises a slatted bed to place an upper mattress therein, wherein the upper frame has side rails to prevent a toddler from falling. The upper frame further comprises an upper entry to access the upper mattress. The lower frame lies vertically below the upper frame and comprises a lower slatted bed to place a lower mattress therein, wherein the lower frame has side rails to prevent a toddler from falling. The lower frame further comprises a lower entry to access the lower mattress. The toddler bunk beds further comprise a ladder positioned generally vertically or at an angle to the frames in order to climb up to the upper mattress via the upper entry. The independent drawer can include two slots or partitions to keep belongings/clothing of the two resident toddlers.

In this manner, the novel toddler bunk bed of the present invention accomplishes all of the forgoing objectives and provides a relatively safe and convenient solution for providing bunk beds for toddlers, while preventing them from falling down on the ground and getting injured. The toddler bunk beds of the present invention are also toddler friendly, as they allow the toddlers to climb up to the top bed using a firm ladder attached to the bed frames. The bed frames also include safety side rails to prevent the toddlers from falling out of their respective beds. Additionally, the beds of the toddler bunk bed are at a safe height, further ensuring the safety of the toddlers. Further, the toddler bunk bed includes storage space to keep the belongings of the toddlers, without occupying additional space in the room for cabinets or dressers.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one potential embodiment thereof, comprises improved toddler bunk beds designed for children who are too large for a crib and too small for a twin bed. The bunk beds comprise: four corner poles designed in vertical orientations; an upper frame secured to the four poles; a lower frame secured to the four poles; and an independent drawer secured to the bottom of the four poles. The upper frame comprises a slatted bed to place an upper mattress therein, wherein the upper frame has side rails to prevent a toddler from falling. The upper frame further comprises an upper entry to access the upper mattress. The lower frame lies vertically below the upper frame and comprises a lower slatted bed to place a lower mattress therein, wherein the lower frame has side rails to prevent a toddler from falling. The lower frame further comprises a lower entry to access the lower mattress. The toddler bunk beds further comprise a sturdy ladder positioned generally vertically or at an angle to the frames, in order to safely climb up to the upper mattress via the upper entry. The independent drawer can include two slots or partitions to keep belongings/clothing of the two resident toddlers.

In a further embodiment of the present invention, novel toddler bunk beds are disclosed and comprises: an upper frame secured to four vertical poles; the upper frame having side rails to prevent a toddler from falling out; an upper entry as a cut out in one of the surfaces of the upper frame to allow easy entry of the toddler; a lower frame secured to the four vertical poles; the lower frame having side rails to prevent a toddler from falling out; a lower entry as a cut out in one of the surfaces of the lower frame to allow easy entry of the toddler; a drawer beneath the lower frame having a sliding mechanism to store belongings/clothing of the toddlers using the toddler bunk beds; and, a ladder removably secured to the upper frame and the lower frame wherein the ladder is used to climb to an upper mattress placed on a slatted surface of the upper frame.

The advantage of the toddler bunk beds of the present invention is that it enables space-savings in a room for families with multiple small toddlers. The bunk beds offer toddlers a place to sleep that is the ideal size, and not too big and not too small. The upper frame allows toddlers to have bunk beds set up without the risk of falling from a dangerous height. The bunk beds include storage space in the form of a drawer to store belongings and clothing of the toddlers. The bunk beds can come in different colors and sizes and can have different designs such as cartoons or other desired themes.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
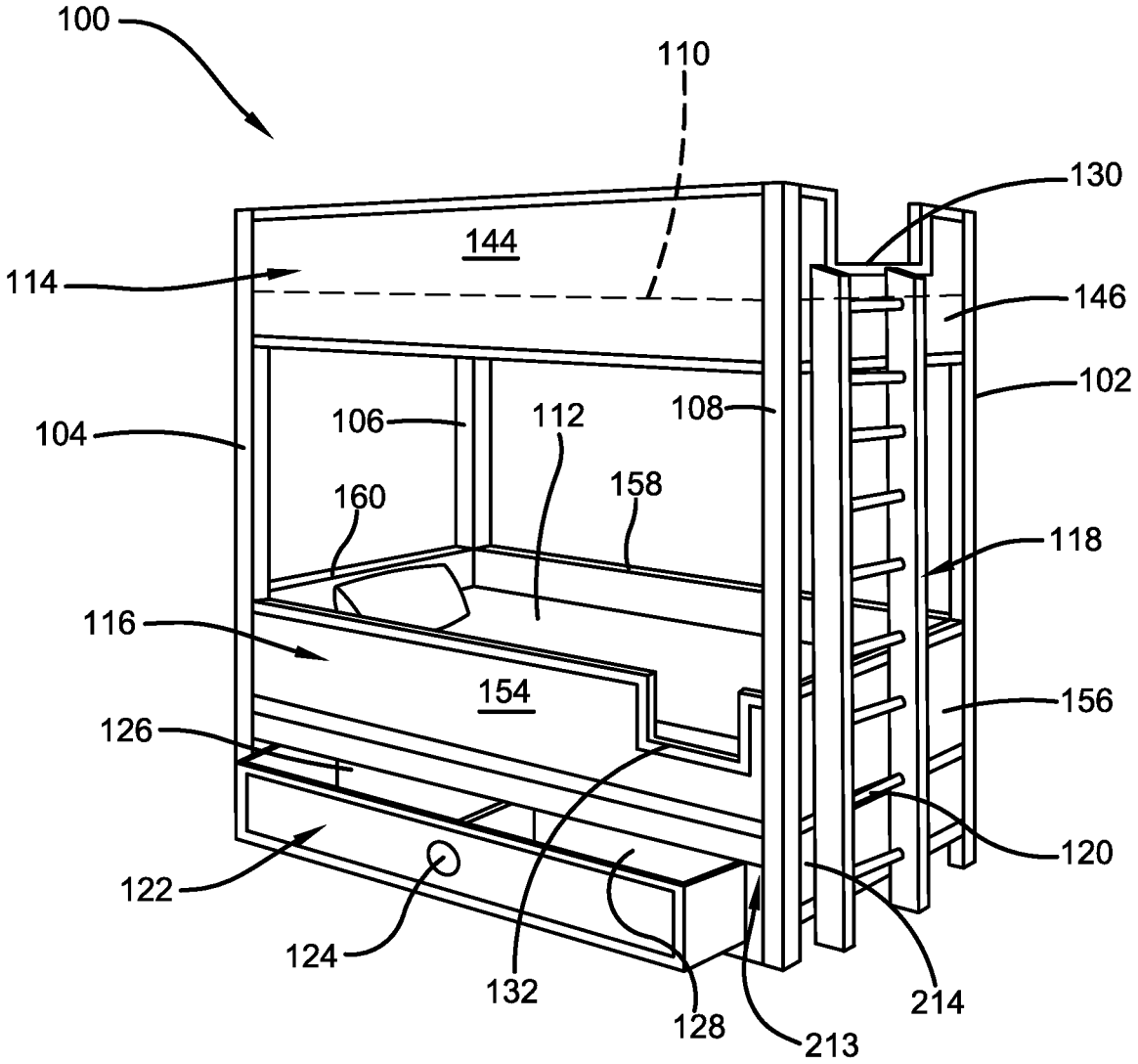
FIG. 1 illustrates a side perspective view of one potential embodiment of the toddler bunk bed of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

The present invention, in one potential embodiment thereof, comprises improved toddler bunk beds designed for children who are too large for a crib, yet too small for a twin bed. The bunk beds comprise: four corner poles designed in vertical orientations; an upper frame secured to the four poles; a lower frame secured to the four poles; and an independent drawer secured to the bottom of the four poles. The upper frame comprises a slatted bed to place an upper mattress therein, wherein the upper frame has side rails to prevent a toddler from falling. The upper frame further comprises an upper entry to access the upper mattress. The lower frame lies vertically below the upper frame and comprises a lower slatted bed to place a lower mattress therein, wherein the lower frame has side rails to prevent a toddler from falling. The lower frame further comprises a lower entry to access the lower mattress. The toddler bunk beds further comprise a sturdy ladder positioned generally vertically or at an angle to the frames in order to climb up to the upper mattress via the upper entry. The independent drawer can include two slots or partitions to keep belongings/clothing of the two resident toddlers.

Referring initially to the drawings, FIG. 1 illustrates a side perspective view of one potential embodiment of the toddler bunk bed 100 of the present invention in accordance with the disclosed architecture. The toddler bunk beds 100 of the present invention include a space-saving bedroom furniture option and are ideal for a plurality of children. The toddler bunk beds 100 are smaller in size in comparison to conventional bunk beds in height, width and length to safely accommodate toddlers. The toddler bunk beds 100 have no sharp edges, include rounded corners, are eco-friendly, and are made up of wood or hard plastic. The toddler bunk beds 100 come in various sizes for toddlers from age three to twelve, generally.

The toddler bunk beds 100 have four rounded poles forming the mounting structure of the bunk beds 100. The poles 102, 104, 106, 108 are rounded and are of the same height. Each respective corner of an upper frame 114 is independently mounted to an individual pole 102, 104, 106, 108. Similarly, each respective corner of a lower frame 116 is independently mounted to an individual pole 102, 104, 106, 108. The height of each pole is 48" in one potential embodiment. An upper mattress 110 is surrounded by the upper frame 114 and can be accessed by climbing up a ladder 118 using the steps 120. An upper mattress entry 130 is present on a foot wall 146 of the upper frame 114 for a toddler to access the upper mattress 110. A lower mattress 112 is present below the upper frame 114 and is surrounded by the lower frame 116. The lower frame 116 has a lower mattress entry 132 accessible along a side wall 154 to access or sit on the lower mattress 112.

The upper mattress 110 and the lower mattress 112 can have the same dimensions and can be up to 72 inches in length and 40 inches in width. The upper frame 114 and the lower frame 116 can have the same dimensions, and can be up to 74 inches in length and 42 inches in width, for example, to provide clearance for the associated mattresses 110, 112. The upper frame 114 is in an elevated position and the lower frame 116 is in a lower position, thus, helping saving space and allowing children or toddlers to enjoy a safe sleeping environment in restricted space.

At the bottom of the toddler bunk beds 100, an independent drawer 122 with a sliding mechanism is present beneath the lower frame 116. The drawer 122 includes a knob 124 to provide a handle for pulling the drawer 122 from its recessed position. The drawer 122 can have two partitioned areas i.e., a first partition area 126 and a second partition area 128 to provide storage for each child's belongings/clothing.

The upper frame 114 comprises upper rails or side walls around the upper mattress 110 to prevent a toddler from falling the upper mattress 110. Similarly, the lower frame 116 comprises lower rails or side walls around the lower mattress 112 to prevent a toddler falling from the lower mattress 112. In one embodiment, the height of both the upper frame 114 and the lower frame 116 can be up to fourteen inches, generally.

The height of the drawer 122 can be generally about eight inches and is covered by the lower frame 116. Further, the gap between the upper frame 114 and the lower frame 116 can be generally about thirty-three inches, for example. The mattress can be supported on slats which can be of birch veneer, beech veneer, and may include an adhesive resin for securing the veneers to the slats. The bunk beds 100 can support foam mattresses and can include accessories, such as curtains to offer privacy. and bed pockets to retain essential items therein. The bunk beds 100 have the capacity to handle a combined weight up to 300 lbs.

The toddler bunk beds 100 comprise durable and reliable constructions. Further, the beds 100 have a low cost of manufacture with regard to both materials and labor, and which accordingly are then amenable to modest retail prices to consumers public, thereby making such a furniture bed assembly economically available to the buying public.

Figure 2:
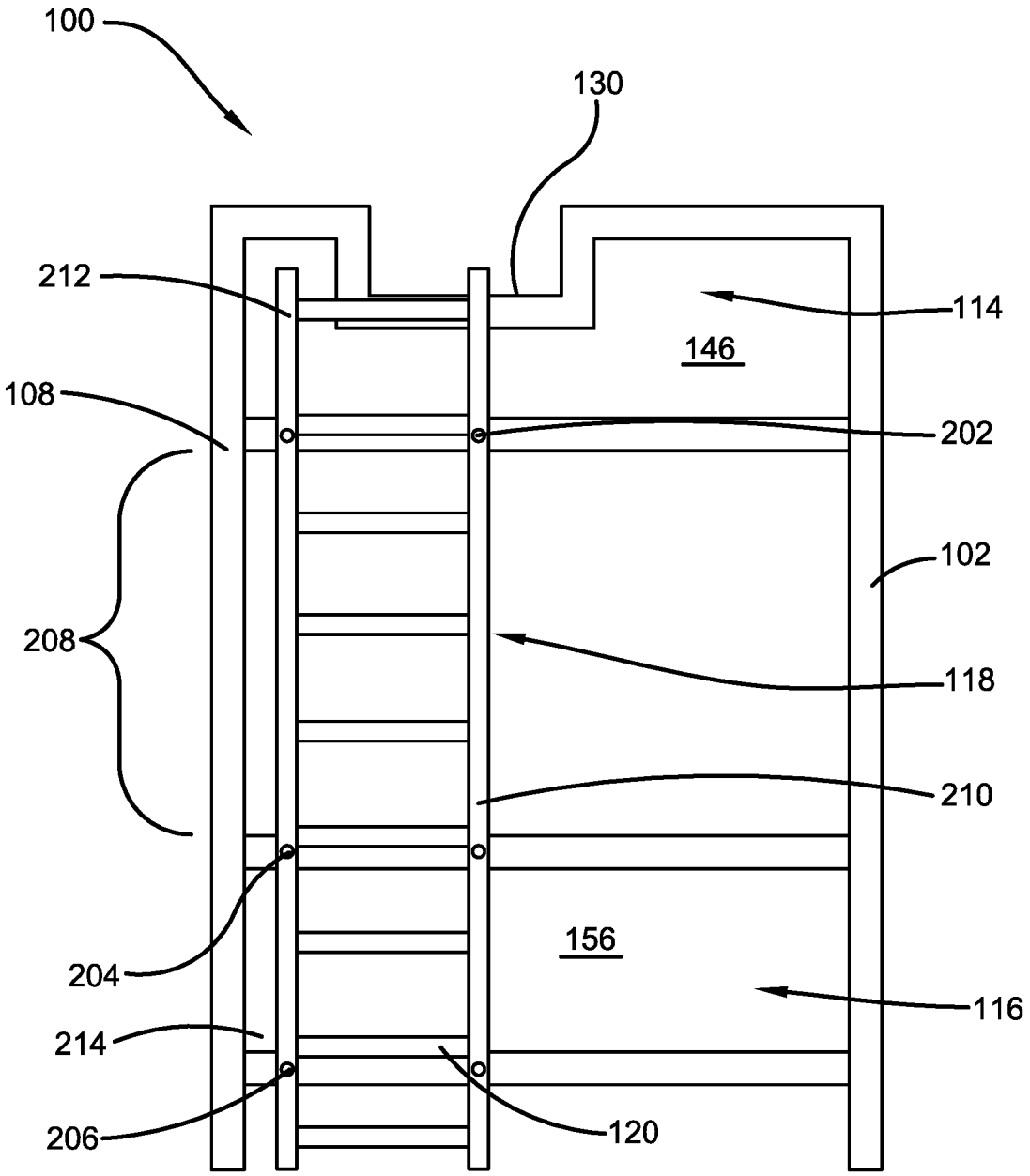
FIG. 2 illustrates a front perspective view of one potential embodiment of the toddler bunk bed of the present invention in accordance with the disclosed architecture, wherein the ladder to the upper mattress is prominently displayed.

FIG. 2 illustrates a front perspective view of one potential embodiment of the toddler bunk bed 100 of the present invention in accordance with the disclosed architecture, wherein the ladder to the upper mattress is prominently displayed. More specifically, a ladder 118 having two arms 210, 212 is removably attached to the bunk beds 100 and is used for a toddler to safely climb up to the upper mattress 110 via upper entry 130. The ladder 118 may be generally vertical or at a slanted angle depending on the design and requirements of the users.

The ladder 118 is secured to the bunk beds 100 at a plurality of places such that the ladder 118 remains secure and stable when a toddler climbs up the ladder 118. The ladder 118 can be screwed to the upper frame 114 with a first pair of screws 202. The ladder's steps 120 are easily accessible in the open space 208 between the upper frame 114 and the lower frame 116. The ladder 118 can be screwed to the lower frame 116 with a second pair of screws 204. To give support at the lower portion of the ladder 118, a third pair of screws 206 can be screwed to a side surface 214 frame support of the drawer 122.

The ladder 118 is removably attached to the bunk beds 100 and in one embodiment, can be placed at a slanted angle with respect to the upper frame 114. The ladder 118 should be of sturdy construction and be detachable for repositioning to best use the surrounding space of the room. The steps 120 are grooved for safe and comfortable climbing. The ladder 118 can be reversible and the number of steps can vary depending on the length of the ladder and the height of the toddler bunk beds 100. The ladder 118 can be placed such that a toddler easily reaches the upper entry 130 of the upper frame 114 to reach the upper mattress 110. The ladder 118 can be constructed using rounded corners so as to prohibit any sharp edges, which may cause injury.

Figure 3:
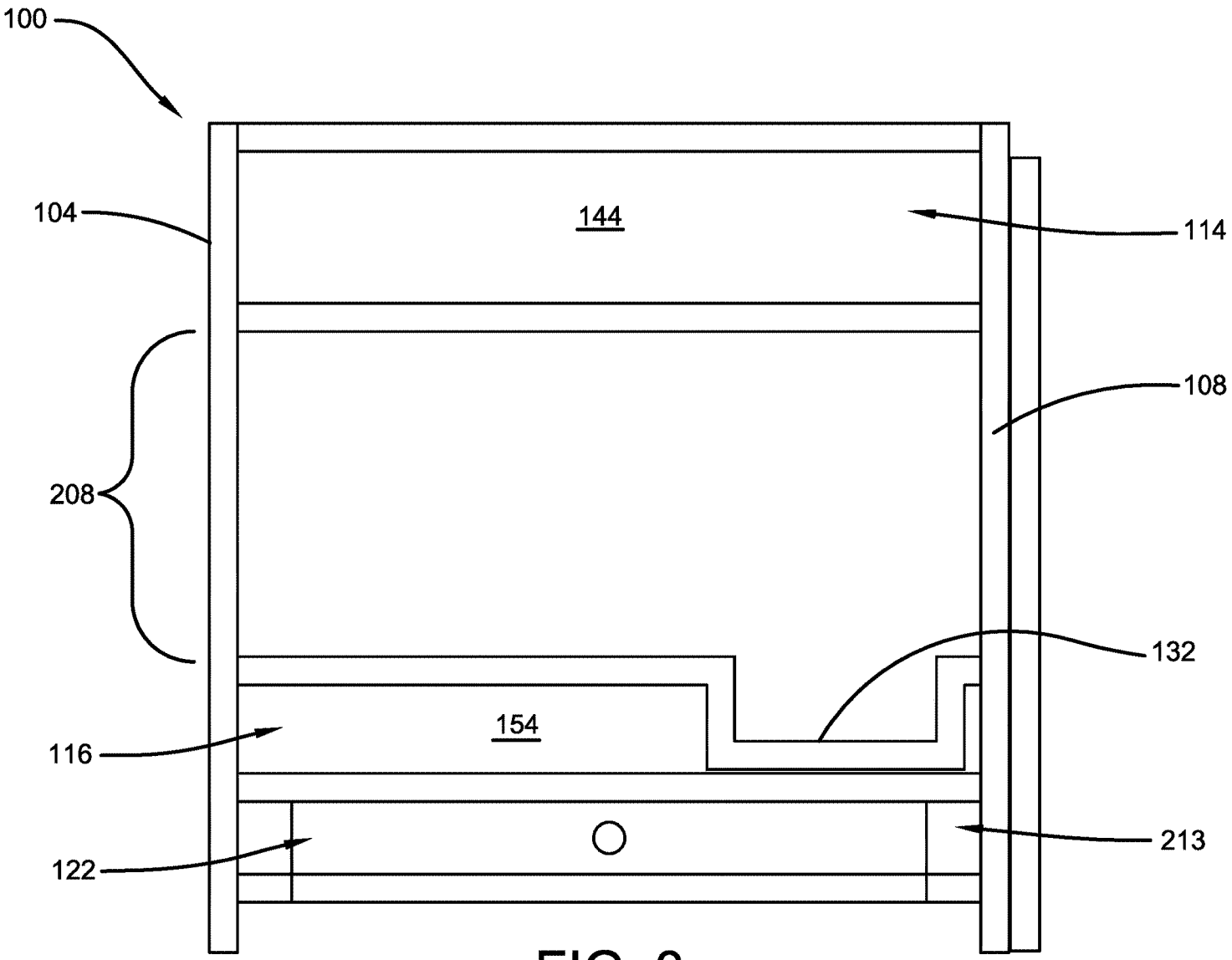
FIG. 3 illustrates a side perspective view of one potential embodiment of the toddler bunk bed of the present invention in accordance with the disclosed architecture, wherein the drawer and the lower mattress entry are prominently displayed.

FIG. 3 illustrates a side perspective view of one potential embodiment of the toddler bunk bed 100 of the present invention in accordance with the disclosed architecture, wherein the drawer and the lower mattress entry are prominently displayed. More specifically, to provide access to the lower mattress 112, the lower entry or lower bed opening 132 in the lower frame 116 is present, via which a toddler can easily jump onto the lower mattress 112. A toddler can easily stand (not illustrated) on the lower mattress without fear of banging his/her head on the upper frame 114, as the space 208 between the lower frame 116 and the upper frame 114 is generally about thirty-three inches.

As is shown and is consistent with the illustrations included with the present application, it will be appreciated that each entry opening 130, 132, is essentially a U-shaped notch having a central section and an upper edge that is open and in communication with the open central section so as to receive a toddler entering or exiting a respective mattress area. Importantly, each entry opening 130, 132 includes a bottom edge that is upwardly offset (i.e., upwardly displaced) from a bottom edge of a respective side wall or in wall, respectively. Again, the geometry shown and described herein carries out the objectives of a bunkbed for toddlers that provides an extra structural element of safety such that the toddler will not inadvertently fall out of bed and, in fact, introduces a new level of difficulty or intentionality when a toddler seeks to egress over regress from the mattress area.

The lower frame 116 is just above the independently-mounted drawer 122 and the toddler sleeping on the lower mattress 112 is not affected by the sliding movement or actuation of the drawer 122. The sliding movement of the drawer 122 is smooth and does not affect the stability of the bunk beds 100 or any of the components. It is to be appreciated that the drawer 122 is slidably retained within a frame 213 wherein each corner of the frame 213 is independently mounted to lower portions of the poles 102, 104, 106, 108. The frame 213 retains the drawer 122 in an independent connection to the poles 102, 104, 106, 108 whereby the vibrations of the sliding motion, for example actuation of the drawer 122 moving in and out does not get translated to the lower frame 116, and does not affect a toddler sleeping on the lower mattress 112.

The toddler bunk beds 100 of the present invention are smaller in size than typical bunk beds and are designed and dimensioned specifically for children who are too large for a crib yet too small for a twin bed. The bunk beds 100 have a compact configuration and can come in attractive colors and designs. The children remain safe while sleeping or playing on the upper mattress 100 and the lower mattress 112 due to the side railings or side walls 144, 154 and foot walls 146, 156 of the upper frame 114 and the lower frame 116, respectively.

Figure 4:
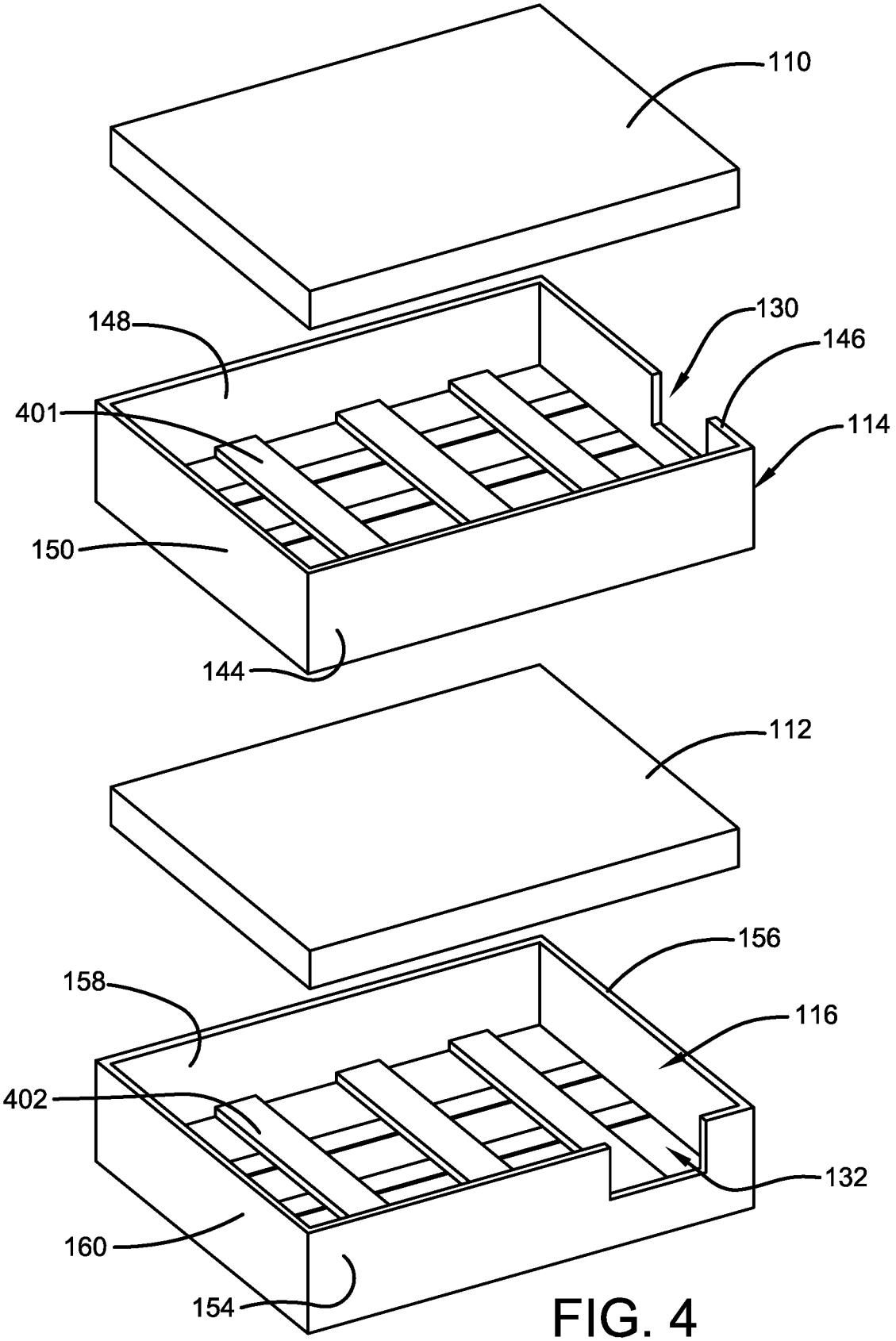
FIG. 4 illustrates a partial perspective and exploded view of one potential embodiment of the slatted bed bases and mattresses of the toddler bunk bed of the present invention in accordance with the disclosed architecture.

FIG. 4 illustrates a partial perspective and exploded view of one potential embodiment of the slatted bed bases and mattresses of the toddler bunk bed 100 of the present invention in accordance with the disclosed architecture. More specifically, the upper mattress 110 can be placed on an upper slatted base 401 which is enclosed by upper frame 114. Similarly, the lower mattress 112 can be placed on a lower slatted base 402 which is enclosed by the lower frame 116. The upper mattress 110 and the lower mattress 112 are removably placed on the slatted bases 401, 402. The slatted bases 401, 402 are sturdy, compact and stable and can be constructed to support up to 150 lbs. each. The slatted bases 401, 402 may be made from wood, metal or heavy plastic. The slatted bases provide a flexible yet secure foundation for the mattresses resting thereon. The slatted bases 401, 402 of the bunk beds 100 each have similar dimensions and are made from similar materials. The mattresses can be easily placed and removed from the slatted bases.

In one embodiment, the upper frame 114 along with the upper slatted base 401 may be removed from the poles 102, 104, 106, 108 to convert the bunk beds 100 into a single separate low-rise bed. In this alternative embodiment, the upper frame 114 previously secured to the poles of the bunk beds 100 is easily removed by unscrewing the retainers and removing the upper frame 114 from the poles 102, 104, 106, 108.

The walls 144, 146, 148, 150 of upper frame 114, and the walls 154, 156, 158, 160 of lower frame 116 act as guard rails around the bunk beds to protect the toddlers or kids from falling out of the beds. The upper frame 114 includes the ingress and egress upper bed opening 130. The lower frame 116 includes the ingress and egress lower bed opening 132. The upper bed opening 130 is in a plane aligned with the foot wall 146 of the upper frame 114. The lower bed opening 132 is in a plane aligned with the side wall 154 of the lower frame 116. The upper opening plane is oriented generally orthogonal to, or generally about 90 degrees from the lower opening plane. In this orientation, an occupant entering or exiting the upper frame 114 does not interfere with another occupant entering or exiting the lower frame 116. In order for an occupant to egress from the lower bed opening 132, the occupant has to align him or herself generally 90 degrees from the lower bed mattress 112 alignment, and traverse nearly the entire length and width of the lower bed mattress 112 (i.e. a distance of nearly the entire length and width of the lower frame 116). It is to be appreciated that the amount of traversal and alignment necessary for egress from the lower bed opening 132 is significant, such that accidental or inadvertent egress is inhibited. In order for an occupant to egress from the upper bed opening 130, the occupant must move their body in a prone position and traverse nearly the entire length of the upper mattress 110 (i.e. a distance of nearly the entire length of the upper frame 114) to the foot wall 146 of the upper frame 114 and slide his or her legs down onto the ladder 118. It is to be appreciated that the amount of traversal necessary for egress from the upper bed opening 130 is significant, such that accidental or inadvertent egress is inhibited. It is to be further appreciated that side walls 144, 154 prohibit occupants from accidentally or inadvertently rolling out of bed frames 114, 116.

As is shown and is consistent with the illustrations included with the present application, it will be appreciated that the walls 144, 146, 148, 150 of the upper frame 114, and the walls 154, 156, 158, 160 at the lower frame 116 are full and upstanding panels that extend upwardly beyond respective mattresses 110 and 112, each panel having a solid construction not separated by apertures or channels as is the case with traditional bunkbed guardrails.

The lower frame side wall 154 includes a length and the lower bed opening 132 includes a length. The lower bed opening length is generally about 15 percent to about 30 percent of the lower frame side wall length. In one potential embodiment, the lower bed opening length is generally about 11 inches to about 22 inches. The upper frame foot wall 146 includes a length and the upper bed opening 130 includes a length. The upper bed opening length is generally about 30 percent to about 50 percent of the upper frame foot wall length. In one potential embodiment, the upper bed opening length is generally about 12 inches to about 21 inches. The aforementioned dimensions enable occupant egress from openings 130, 132 once the occupant deliberately orients his or herself in a prone position aligned with the respective openings 130, 132. The deliberate orientations necessary for occupant egress inhibit inadvertent or accidental egress, thus providing a safe sleeping environment for toddlers.

The frames can have names of the toddlers engraved on them to give a personalized touch to the bunk beds 100. The mattresses used with the bunk beds can be standard single size mattresses. The bunk beds 100 allow two toddlers to sleep in the space of one bed with safety and convenience. In one embodiment, the lower mattress may be fourteen centimeters thick and the upper mattress may be sixteen centimeters thick. The toddler bunk beds 100 can be installed by an adult using an installation guide that comes with the bunk beds 100.

Figure 5:
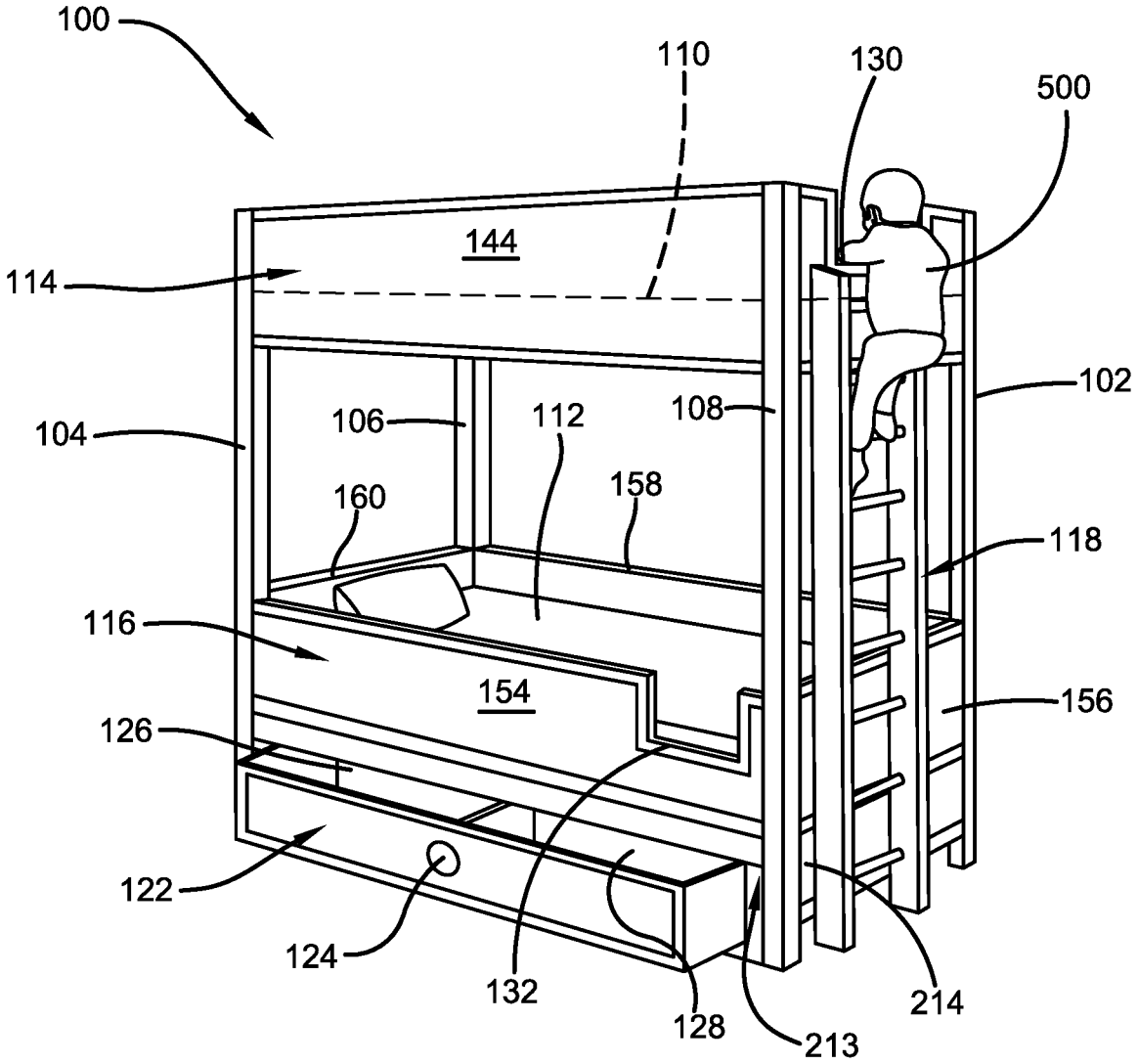
FIG. 5 illustrates a side perspective view of one potential embodiment of the toddler bunk bed of the present invention in accordance with the disclosed architecture, wherein a toddler is using the ladder to access the upper mattress of the bunk bed.

FIG. 5 illustrates a side perspective view of one potential embodiment of the toddler bunk bed 100 of the present invention in accordance with the disclosed architecture, wherein a toddler is using the ladder to access the upper mattress of the bunk bed. As shown, a toddler 500 easily uses the ladder 118 to climb up to the upper mattress 110 through the upper mattress entry 130. The toddler 500 can step up over the steps 120 of the ladder to head towards the top of the ladder 118, and further enters the top bed frame 114 of the toddler bunk beds 100. Once the toddler 500 reaches the top bed frame 114, the toddler 500 can safely sleep on the top mattress 110. In an embodiment of the present invention, the upper frame 114 and the lower frame 116 can be comprised of a slotted structure, or any other design as per the desires of the users.

The toddler bunk beds 100 can be constructed of rounded edges and should be void of toxic or lead paints. In one potential embodiment, the beds 100 can have illumination sources such as soft LED lights attached to the bed frames, or other components. The toddler bunk beds 100 can be marketed as a kit comprising modular components, such as upper frame, lower frame, storage box, ladder, mattresses, screws and more, which can be easily connected by the users. The kit can include a manual comprising instructions for assembling the components and setting up the toddler bunk beds.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "toddler bunk bed", "toddler bunk beds", "bed" and "bunk bed" are interchangeable and refer to the toddler bunk bed 100 of the present invention.

Notwithstanding the forgoing, the toddler bunk bed 100 of the present invention can be of any suitable size and configuration as is known in the art without affecting the overall concept of the invention, provided that it accomplishes the above-stated objectives. One of ordinary skill in the art will appreciate that the size, configuration and material of the toddler bunk bed 100 as shown in the FIGS. are for illustrative purposes only, and that many other sizes and shapes of the toddler bunk bed 100 are well within the scope of the present disclosure. Although the dimensions of the toddler bunk bed 100 are important design parameters for user convenience, the toddler bunk bed 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A furniture assembly comprising:

four mounting poles;

an upper bed comprised of an upper frame having four corners, wherein each of said four corners are independently mounted to an upper portion of a respective one of the four mounting poles;

wherein said upper bed includes an upper mattress mounted atop a bottom of said upper frame;

wherein said upper frame includes an upper head wall, an upper foot wall that is parallel to and displaced from said upper head wall, and a pair of upper sidewalls that are laterally spaced apart and extending between opposed ends of said upper head wall and opposed ends of said upper foot wall, respectively;

wherein said upper head wall, said upper foot wall and said pair of upper sidewalls each includes an upper edge that is above an upper surface of the upper mattress so as to form a barrier against egress;

wherein said upper foot wall defines an upper frame egress opening positioned between said opposed ends of said upper foot wall;

a lower bed comprised of a lower frame having four lower corners, wherein each of said four lower corners is independently mounted to a lower portion of a respective one of the four mounting poles, said lower frame including a lower head wall, a lower foot wall that is parallel to and displaced from said lower head wall, and a pair of lower sidewalls that are laterally spaced apart and extending between opposed ends of said lower head wall and opposed ends of said lower foot wall;

wherein a respective one of said pair of lower sidewalls defines a lower frame egress opening positioned adjacent a respective opposed end of said lower foot wall;

said upper frame egress opening being positioned in a plane aligned with said foot wall of said upper frame;

said lower frame egress opening being positioned in a plane aligned with a respective sidewall of said lower frame, wherein said upper frame egress opening plane is oriented generally orthogonal to said lower frame egress opening plane;

wherein the upper bed is completely removable from the furniture assembly;

wherein said lower sidewalls, said upper sidewalls, said lower head wall, said lower foot wall, said upper head wall, and said upper foot wall each has a unitary panel construction;

wherein:

said upper frame egress opening is a U-shaped notch defining (1) an open center section and an open top edge in communication with said open center section and (2) a closed bottom edge upwardly offset and displaced above said upper surface of said upper mattress so as to provide a barrier against egress;

said lower frame egress opening is a U-shaped notch defining (1) an open center section and an open top edge in communication with said open center section and (2) a closed bottom edge upwardly offset from a bottom edge of said respective one of said pair of lower sidewalls.

* * * * *